US005628274A

United States Patent [19]

Biedenweg et al.

[11] Patent Number: 5,628,274

[45] Date of Patent: May 13, 1997

[54] BOAT INGRESS/EGRESS SYSTEM AND RAMP

[75] Inventors: Baron Biedenweg; Mike Neher; Brad Davis, all of Fort Wayne, Ind.

[73] Assignee: Harris Kayot, Inc., Fort Wayne, Ind.

[21] Appl. No.: 505,870

[22] Filed: Jul. 24, 1995

[51] Int. Cl.[6] ..... B63B 17/00

[52] U.S. Cl. ..... 114/362

[58] Field of Search ..... 114/343, 361, 114/362, 230

[56] References Cited

U.S. PATENT DOCUMENTS

| | | | |
|---|---|---|---|
| 2,641,785 | 6/1953 | Pitts et al. | 14/71 |
| 3,095,848 | 7/1963 | Dick | 114/230 |
| 4,084,713 | 4/1978 | Rohrs et al. | 214/85 |
| 4,161,795 | 7/1979 | Quest | 9/1.6 |
| 4,287,625 | 9/1981 | Dawson | 114/362 |
| 4,293,967 | 10/1981 | Ord | 9/1.6 |
| 4,297,963 | 11/1981 | Beacom | 114/230 |
| 4,846,303 | 7/1989 | Cooper et al. | 182/36 |
| 4,899,681 | 2/1990 | Ottsman et al. | 114/230 |
| 5,044,829 | 9/1991 | Hemminger | 405/203 |
| 5,191,854 | 3/1993 | Lehmann et al. | 114/362 |
| 5,222,456 | 6/1993 | Friedrich | 114/362 |

*Primary Examiner*—Stephen Avila
*Attorney, Agent, or Firm*—Taylor & Associates, P.C.

[57] ABSTRACT

The invention is directed to an ingress/egress system for allowing ingress/egress to and from a fixed structure, such as a pier or dock, and a boat having a superstructure. The ingress/egress system includes a ramp connected to the superstructure, which ramp is movable between a first position and a second position. At least two rigid extension arms are pivotally connected to the superstructure, with each extension arm including a device for connecting to the fixed structure. The extension arms together define a device for controlling movement of the boat in directions toward and away from the fixed structure.

7 Claims, 3 Drawing Sheets

BOAT INGRESS/EGRESS SYSTEM AND RAMP

BACKGROUND OF THE INVENTION

1. Field Of The Invention

The present invention relates to boats, and, more particularly, relates to an ingress/egress system for boats.

2. Description Of The Related Art

It is known to provide a step assembly or ladder which is connected to the side of a boat, and which allows ingress/egress to and from the boat. The ladder is generally disposed in a vertical position and extends below the surface level of the water in which the boat is disposed. The ladder allows ingress to the boat by a person disposed in the water, and conversely allows egress from the boat by a person disposed therein. The step assembly is typically used to interconnect a fixed structure, such as a pier, with a boat. The end of the steps adjacent the boat are disposed a distance away from the boat, such as the width of a step, and do not line up with the upper surface of the boat.

A problem with ladders and step assemblies used to provide ingress/egress to and from a boat is that the boat cannot be easily boarded or disembarked by a person with a physical handicap. The steps and ladder rungs do not allow easy traversal thereof by a person who has difficulty walking or is confined to a wheelchair.

It is also known to provide an ingress/egress ramp to allow boarding and disembarking of a boat. However, such ramps are configured to connect to the boat at a location which is above or below the upper surface, e.g., deck, of the boat. It is therefore difficult, if not impossible, for a person having a physical handicap to board and disembark a boat using such ramps.

Finally, it is also known to use a ramp on a land vehicle (such as a van) for allowing access to and from the land vehicle via a person in a wheelchair. However, such ramps merely lie on top of the floor of the vehicle, and thereby include an end which extends above the floor of the vehicle and inhibits use of the ramp by a person in a wheelchair. Further, with a land vehicle, such as a van, the van is sitting on a fixed structure (i.e., ground) with which the ramp engages. Accordingly, in contrast with a boat which moves up and down because of wave action, there is substantially no relative movement between the van and the ground. Thus, it is not necessary to connect the ramp to the ground, or to otherwise maintain the van at a predetermined position relative to the ground for proper use of the ramp.

What is needed in the art is an ingress/egress system for a boat which allows a person having a handicap to relatively easily board and disembark the boat.

SUMMARY OF THE INVENTION

The present invention provides an ingress/egress system for a boat, including a ramp which is pivotally connected to a superstructure of the boat and movable to a down, loading position; and at least two extension arms which are attachable to a fixed structure (e.g., a pier or dock) and maintain the boat a predetermined distance away from the pier or dock. The ramp includes an upper surface which is disposed closely adjacent to an upper surface of the boat deck when the ramp is in the down, loading position.

The invention comprises, in one form thereof, an ingress/egress system for allowing ingress/egress to and from a fixed structure, such as a pier or dock, and a boat having a superstructure. The ingress/egress system includes a ramp connected to the superstructure, which ramp is movable between a first position and a second position. At least two rigid extension arms are pivotally connected to the superstructure, with each extension arm including a device for connecting to the fixed structure. The extension arms together define a device for controlling movement of the boat in directions toward and away from the fixed structure.

An advantage of the present invention is that a boat can be relatively easily boarded by a handicapped person, in comparison with conventional boarding apparatus.

Another advantage is that the boat can be maintained a predetermined distance from the pier, thereby allowing proper use of the ramp.

Yet another advantage is that up and down movement of the boat relative to the pier is accommodated, while still allowing use of the ramp for ingress/egress to and from the boat.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF TEE INVENTION

Figure 1:
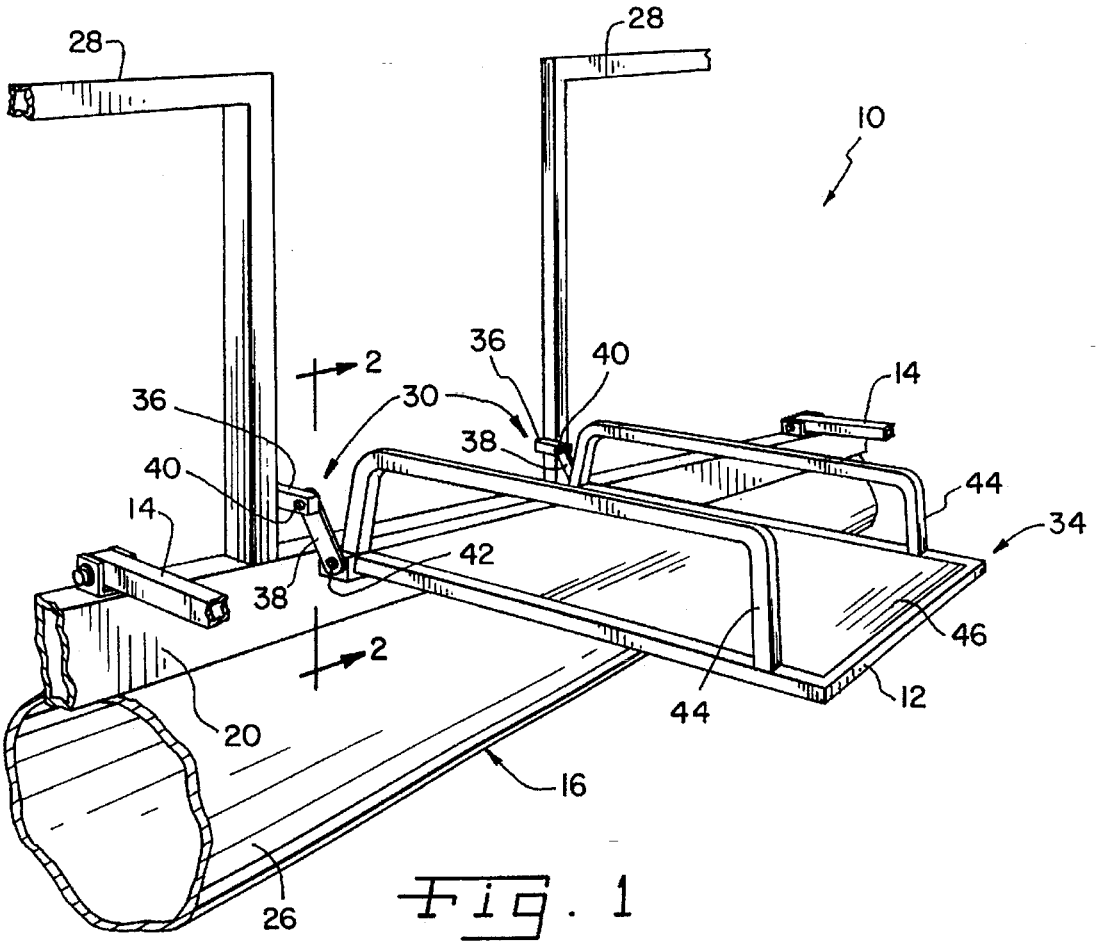
FIG. 1 is a fragmentary, perspective view which shows an embodiment of a boat ingress/egress system of the present invention, with the ramp shown in the down position.

Referring now to the drawings, and particularly to FIG. 1, there is shown an ingress/egress system 10 of the present invention, including a ramp 12 and extension arms 14 (partially shown in FIG. 1) which are attached to a boat 16. Ingress/egress system 10 allows entry and exit to and from boat 16, and positions boat 16 relative to a fixed structure 18 (FIG. 2), such as a pier or a dock.

Boat 16 includes a superstructure 20 having a deck 22 with an upper surface 24. Superstructure 20 also includes a pair of floatation tubes, one of which is shown and referenced 26 in FIGS. 1 and 2, which provide floatation to boat 16. Additionally, superstructure 20 is connected to a railing 28 which extends upwardly therefrom, and is disposed about the perimeter of deck 22. Thus, in the embodiment shown in FIGS. 1 and 2, it will be apparent to those skilled in the art that boat 16 is configured as a pontoon boat or deck boat; however, the ingress/egress system and ramp of the present invention can be used with other types of boats.

Figure 2:
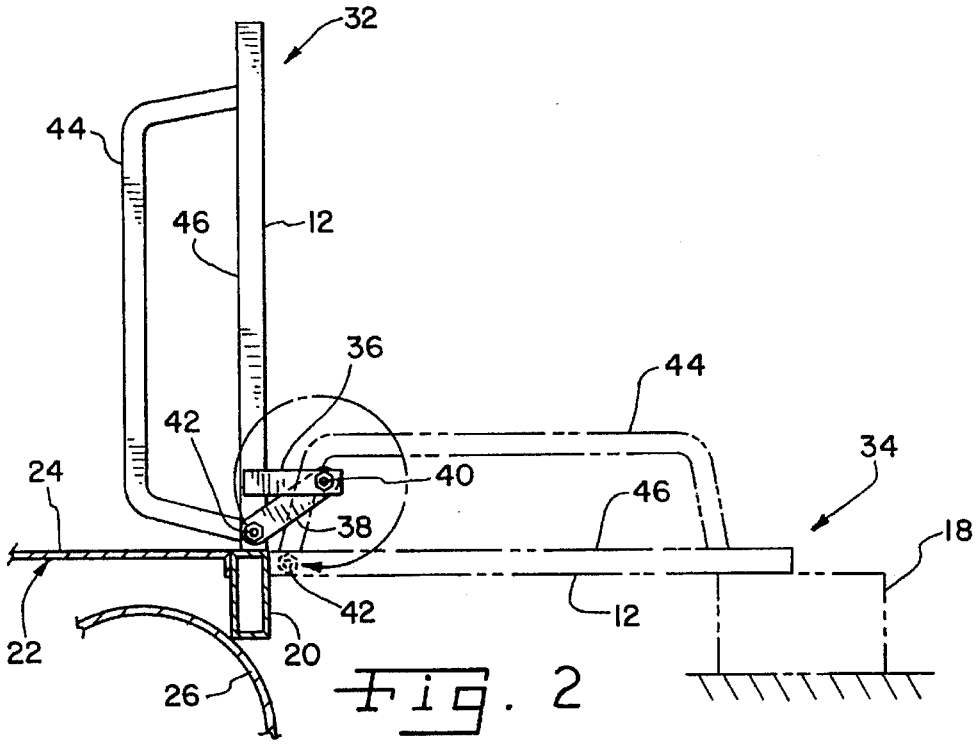
FIG. 2 is a sectional view taken along line 2—2 in FIG. 1.
Figure 5:
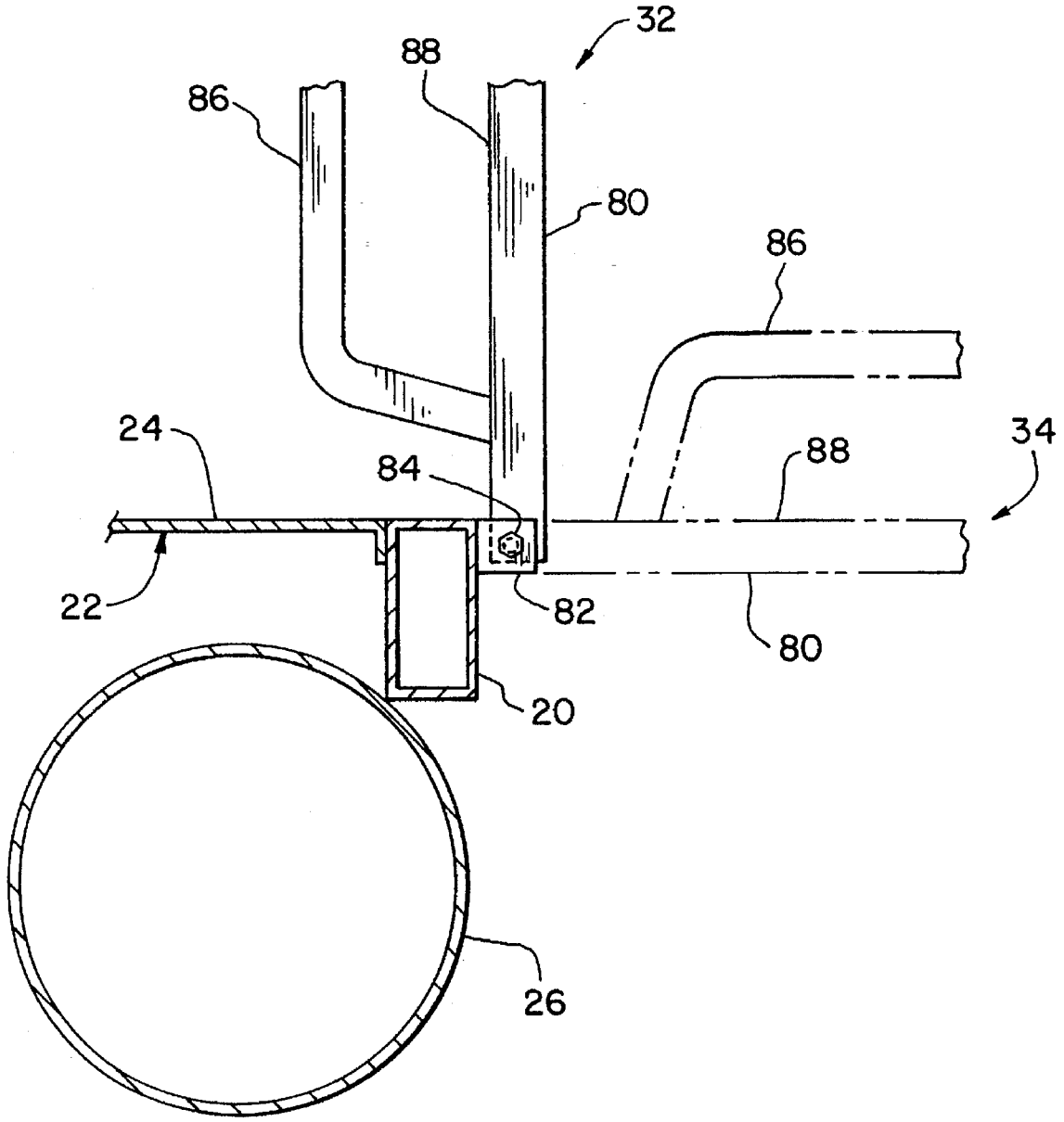
FIG. 5 is a sectional view of another embodiment of the boat ingress/egress system of the present invention.

Ramp 12 is pivotally connected to superstructure 20 (indicated generally by reference number 30), and is movable between a first or upright, transport position 32 (shown in FIGS. 2 and 5), and a second or down, loading position 34 (shown in FIG. 1 and in phantom lines in FIGS. 2 and 5). When disposed in first position 32, ramp 12 functions as a gate along the side of boat 16, and when disposed in second position 34, ramp 12 functions as an ingress/egress ramp to and from boat 16. More particularly, a pair of brackets 36 are each connected to railing 28, and extend outwardly therefrom. Each bracket 36 is pivotally connected to one end of a respective link 38 via a pivot pin 40. Each link 38 is pivotally connected at an opposing end thereof to ramp 12, via a pivot pin 42. Brackets 36, links 38 and ramp 12 therefore define a three bar linkage which allows ramp 12 to pivot from first position 32 to second position 34, and vice versa.

Referring to FIG. 2, it may be seen that link 38 pivots about pivot pin 40 when ramp 12 is moved from first position 32 to second position 34, or vice versa. More particularly, when ramp 12 is in first position 32, as shown in solid lines in FIG. 2, link 38 is oriented in the position shown, such that ramp 12 is disposed generally in line with railing 28. On the other hand, when ramp 12 is in second position 34 (FIG. 1), link 38 is positioned such that pivot pin 42 is disposed in the location indicated by phantom lines in FIG. 2. Link 38 therefore allows ramp 12 to be disposed above or horizontally adjacent to superstructure 20.

Ramp 12 also includes a pair of side railings 44 which are disposed on each side thereof. Side railings 44 provide handles by which ramp 12 can be moved between first position 32 and second position 34, as well as provide railings to inhibit excessive sideways movement of a device moving across ramp 12, such as a wheelchair.

Ramp 12 has a continuous upper surface 46 which, in the embodiment shown, is generally planar. Upper surface 46 is disposed closely adjacent to deck upper surface 24 when ramp 12 is in the second or down, loading position 34, as shown in FIG. 2. It will be appreciated that the angular relationship between ramp upper surface 46 and deck upper surface 24 will vary depending upon the height location of fixed structure 18.

Figure 3:
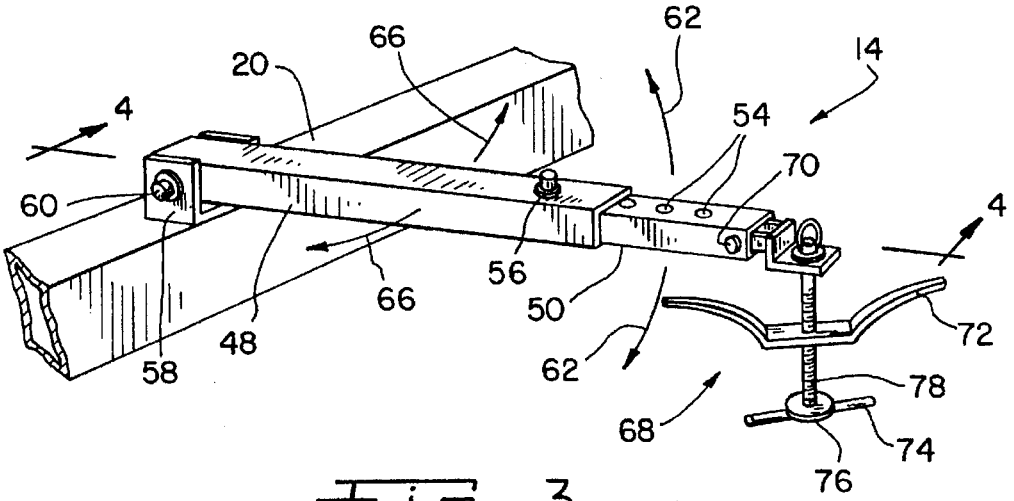
FIG. 3 is a fragmentary, perspective view of an embodiment of an extension arm of the present invention, which is partially shown in FIG. 1.
Figure 4:
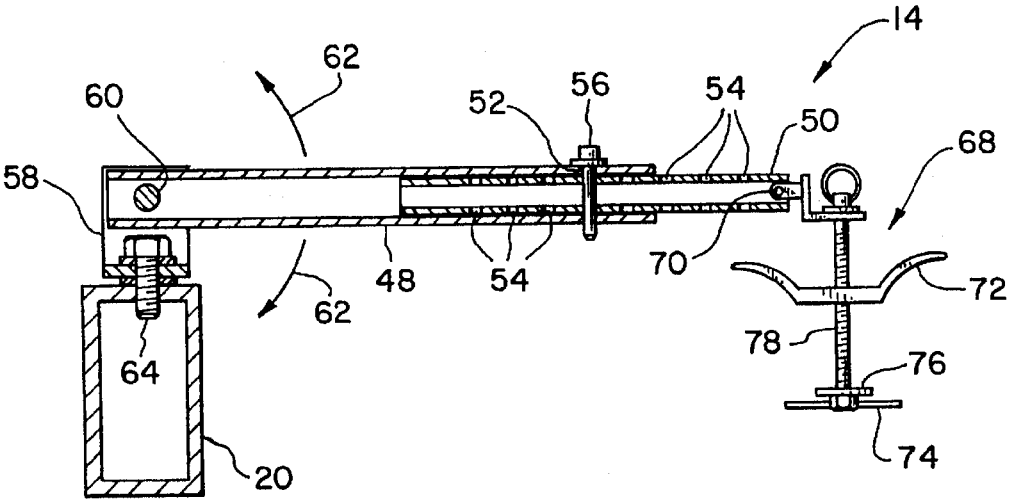
FIG. 4 is a sectional view taken along line 4—4 in FIG. 3.

Referring now to FIGS. 3 and 4, extension arms 14 are shown in greater detail. Each extension arm 14 includes a first arm 48 which is adjustably connected to a second arm 50 at one of a plurality of locations. In the embodiment shown, first arm 48 includes a hole 52, and second arm 50 includes a plurality of holes 54. Second arm 50 is slidingly received within first arm 48, and may be positioned such that one of the plurality of holes 54 aligns with hole 52 formed in first arm 48. A pin 56 is then placed within hole 52 of first arm 48 and the selected hole 54 of second arm 50, to thereby lock first arm 48 and second arm 50 together. Alternatively, first arm 48 can slide within second arm 50.

First arm 48 is pivotally connected to a bracket 58 via a pivot pin 60 which allows movement of extension arm 14 in a generally vertical direction as indicated by directional arrows 62. The pivotal connection between first arm 48 and bracket 58 at pivot pin 60 allows boat 16 to move up and down relative to fixed structure 18 within a predetermined range, such as caused by wave action. Bracket 58 is pivotally connected to superstructure 20 via a bolt 64, thereby allowing movement of extension arm 14 in a generally sideways direction relative to boat 16 as indicated by directional arrows 66. The adjustable, sliding connection between first arm 48 and second arm 50, and pivotal connections between first arm 48, bracket 58 and superstructure 20 allow a connection device (indicated generally at reference numeral 68) to be connected to fixed structure 18 at any desired location.

Connecting device 68 is typically connected to second arm 50 via a pivot pin 70. Connecting device 68 includes a clevis 72 which is threadably connected to a T-bar 74. An optional washer 76 is interposed between clevis 72 and the distal end of T-bar 74, and is free to slide along a threaded portion 78 of T-bar 74.

As shown in FIG. 1, a pair of rigid extension arms 14 are positioned fore and aft of ramp 12, and, when connected to fixed structure 18, control movement of boat 16 relative to fixed structure 18. It will be appreciated that boat 16 may move up and down because of wave action, etc., but the length of extension arms 14 does not change during use. Likewise, ramp 12 may move up and down along with the movement of boat 16, thereby changing the angular relationship between ramp 12 and deck upper surface 24 and fixed structure 18. Nonetheless, when ramp 12 is in the second or down, loading position 34 as shown in FIG. 2, ramp 12 is disposed closely adjacent to upper surface 24 and in contact with fixed structure 18, thereby allowing ingress/egress to boat 16.

In use, boat 16 is positioned along side of a fixed structure 18, such as a pier. Extension arms 14 are adjustably positioned such that T-bar 74 extends through cleats (not shown) of pier 18. T-bar 74 is then rotated 90° and clevis 72 is rotated to affix connecting device 68 to pier 18. Ramp 12 is then moved from the upright, transport position 32, to the down, loading position 34 as shown in phantom lines in FIG. 2. Ramp 12 may then be used for ingress/egress to and from boat 16.

FIG. 5 illustrates another embodiment of a ramp 80 of the present invention. Ramp 80 is pivotally connected to superstructure 20, and is movable between a first or upright, transport position 32, and a second or down, loading position 34 (shown in phantom lines in FIG. 5). More particularly, a pair of brackets (one of which is shown and referenced 82) are connected to superstructure 20, and disposed on each side of ramp 80. Bracket 82 is pivotally connected to ramp 80 via a pivot pin 84. Ramp 80 also includes a pair of side railings which are disposed on each side thereof, one of which is shown and referenced 86 in FIG. 5. A continuous upper surface 88 of ramp 80 is disposed closely adjacent to deck upper surface 24 when ramp 80 is in the second or down, loading position 34, as shown in FIG. 5.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An ingress/egress system for allowing ingress/egress to and from a boat and a fixed structure, the boat including a superstructure having a deck with an upper surface, said ingress/egress system comprising:

a ramp connected to the superstructure, said ramp movable between an upright, transport position, and a down, loading position, said ramp having an end with an upper surface which is disposed adjacent to and substantially coplanar with said deck upper surface when said ramp is in said down, loading position; and at least two rigid extension arms pivotally connected to the superstructure, each said extension arm including means for connecting to the fixed structure, said extension arms together defining a means for controlling movement of the boat in directions toward and away from the fixed structure.

2. The system of claim 1, wherein said ramp is pivotally connected to the superstructure.

3. The system of claim 1, each said extension arm includes a first arm and a second arm, said first arm connected to said second arm at one of a plurality of locations.

4. The system of claim 3, wherein one of said first arm and said second arm includes one hole, and another of said first arm and said second arm includes a plurality of holes, and further comprising a pin disposed in said one hole and another of said plurality of holes.

5. The system of claim 1, wherein each said extension arm includes a means for allowing the boat to move up and down relative to the fixed structure, within a predetermined range.

6. The system of claim 5, wherein said allowing means comprises a pivotal connection between each said extension arm and the superstructure.

7. The system of claim 1, wherein said connecting means comprises a T-bar and a clevis, said clevis threadably connected to said T-bar.

* * * * *